US006032331A

United States Patent [19]

Alonso

[11] Patent Number: 6,032,331

[45] Date of Patent: Mar. 7, 2000

[54] CHECKING MECHANISMS WITH VARIABLE PLANE TRIGGER PLATES

[76] Inventor: Ricardo Alonso, 111 S. Perry St., Denver, Colo. 80219

[21] Appl. No.: 08/980,381

[22] Filed: Nov. 28, 1997

Related U.S. Application Data

[62] Division of application No. 08/677,101, Jul. 9, 1996, abandoned.

[51] Int. Cl.[7] ..... E05F 5/02

[52] U.S. Cl. ..... 16/82; 16/66; 16/49

[58] Field of Search ..... 16/82, 66, 49, 16/71, 72, 84, 85, DIG. 17, DIG. 10

[56] References Cited

U.S. PATENT DOCUMENTS

| | | |
|---|---|---|
| 2,732,920 | 1/1956 | Newton . |
| 2,920,338 | 1/1960 | Falk . |
| 3,032,806 | 7/1962 | Mallory . |
| 3,162,889 | 12/1964 | Runnels . |
| 3,566,435 | 3/1971 | Nakamura . |
| 3,665,549 | 5/1972 | Quinn . |
| 4,194,264 | 3/1980 | Stoffregen . |
| 4,777,698 | 10/1988 | Lord . |
| 4,815,163 | 3/1989 | Simmons . |

FOREIGN PATENT DOCUMENTS

| | | |
|---|---|---|
| 623038 | 4/1961 | Canada . |

*Primary Examiner*—Chuck Y. Mah

[57] ABSTRACT

An improved mechanism (22) for checking reciprocating operative devices (10) to include door systems, by means of an improved rocker-washer mechanism (22) adapted to pivot (24) and frictionally engage the device (10) comprising at least one rod (16) that reciprocatively functions from within a body (12) having a biasing operative means (11), that upon extension of said rod (16) from said body (12), the bias 11-A and 11-B acting to control the reciprocation of said rod (16); the mechanism (22) including a central structure (34) forming an aperture configuration (26) which is mountable and disposable axially (17) upon the surface of the rod (16), said aperture (26) bounding two opposing loci (26-A) and (26-B) relationally composed upon a common axis of symmetry (32) which is realized when mounted upon a cross-section of the rod (16); each locus (26-A) and (26-B) comprising at least one metallic point (28) for creating a substantial friction pressure torsionally applied onto said rod (16) to engage said mechanism (22); the opposing torsion pressure (29) comprised within an axial plane (30) of the mechanism (22) upon said rod (16); said central structure (34) fixated to a trigger plate appendage (38) means to form an angular joint (42) generally of substantially 90 degrees or less at the origin, projectable upon a side view of the rocker-washer mechanism (22) wherein said angle comprises one axis (42-A) projecting upon the face of said central structure (34), and comprises the other axis (42-B) projecting from said origin; said trigger plate appendage (38) further comprising a variable trigger area (40) for transposing said torsion (29), adapted to abut against said body (12) of the device (10), said trigger plate appendage (38) composed as to define said variable trigger area (40) disposable upon a substantial curvature surface, wherein the area (40) permits the means for variable adjustment of said mechanism (22) upon a variable plane (42-C) projected from the axis of origin (40-B), and projected to said trigger area (40); whereby said improvements comprise a superior mechanism (22) for frictionally checking said device (10) upon engagement, thus providing the maximum torsional pressure (29) within the axial plane (30) of said mechanism (22).

18 Claims, 3 Drawing Sheets

List Of Reference Numerals

10 reciprocative device

11 biasing means of 10
11-A outward biasing force
11-B inward biasing force

12 piston body of 10

14 end cap of 12

16 piston rod of 10
16-A curved surfaces
16-B non-curved surfaces

17 axis of 16

18 support hub of 16

20 protruding lugs of 16

22 checking mechanism

24 pivotal engagement of 22
24-A idle position
24-B checking position

26 aperture configuration of 22
26-A fulcrum locus
26-B counter locus

28 opposing friction point of 26

29 direct frictional pressure of 28

30 axial plane of 29

31 center axis of 26

32 common axis of symmetry of 26

34 central structure of 26

36 notches of 26

37 sheet metal gauge of 22
37-B offsetting planes

38 trigger appendage of 22

40 trigger point of 38
40-A arching, ovoid, or convex designed surface
40-B pad or clip
40-C adjustable screw

42 fixated joint of 34 and 38
42-A face axis of 42
42-B origin axis for 42
42-C trigger plane of 40

43 strengthening means of 42

44 adjustment means of 28

46 functional gap between 12 and 34

FIG. 7

CHECKING MECHANISMS WITH VARIABLE PLANE TRIGGER PLATES

This is a division of Ser. No. 08/677,101, filed on Jul. 9, 1996 (07-09 -96), now abandoned.

FIELD OF INVENTION

This invention relates to various reciprocative devices comprising a rod which functions from within a body. The device is utilized for controlling the movement of an object attached onto the device. A reciprocating door closer system installed on a common door exemplifies such a device, by providing a biasing means for varying and controlling the movement of the door. More particularly, this invention comprises an improved apparatus and methodology to frictionally check the reciprocative function of the device, through increased leverage and torsion causing the friction.

BACKGROUND OF THE INVENTION

A portion of the disclosure of this patent document contains material which is subject to copyright protection. The copyright owner has no obligation to the facsimile reproduction by anyone of the patent document or the patent disclosure, as it appears in the Patent And Trademark Office patent file or records, but otherwise reserves all copyright whatsoever.

A brief description of a reciprocating device includes a basic door closer system which comprises a spring operated device controlled with liquid or gas. The device typically contains a piston assembly including a piston and sealing o-ring; piston rod varieties which include curved and non-curved surfaces; internal compression spring and hydraulic biasing operators; cylindrical-piston tube; sealed and non-sealed end caps; fluid restriction valves; attachment members; and the checking mechanism to which this invention pertains. Such door closer systems which comprise checking mechanisms are described in U.S. Pat. Nos. 2,732,920; 2,920,338; 3,032,806; 3,162,889; 3,566,435; 3,665,549; 4,777,698; and Canadian Pat. No. 623,038.

The checking mechanism is utilized to independently hold the door and door closer in an open or extended position for an indefinite period of time. The simplistic mechanism is axially mounted upon the extended rod of the device, for leveraging certain biasing forces controlled by the device into torsion. The torsion is urged between opposing points within an axial plane of the mechanism. The torsion causes substantial direct frictional pressure onto the surfaces of the piston rod. Thus, the mechanism frictionally checks the reciprocative function of the device with direct pressure causing the friction. Among the more elaborate checking mechanisms developed are illustrated in U.S. Pat. No. 4,194,264 to Soffregen (1980), and U.S. Pat. No. 4,815,163 to Simmons (1989). Through variously attached apparati comprising these mechanisms, an elaborate method is created to check the rod of the device similarly to the basic mechanism disclosed herein.

The prior art checking mechanism is usually metal stamped from a sheet material such as a predetermined sheet metal gauge. The mechanism comprises three main components: a) an aperture configuration bounded within a central structure; b) a trigger appendage; and c) a fixated joint connecting component a onto component b. The aperture configuration permits the mechanism to mount upon the rod of the device. The aperture configuration comprises opposing loci which define the opposing friction points. These points create the torsional pressure causing the friction within the axial plane. The central structure provides a boundary for the aperture configuration. The trigger appendage acts as a lever and provides a trigger point for abutment to the piston body. The central structure and the trigger appendage are typically flattened planes composed from the sheet metal gauge. The fixated joint angularly attaches the central structure onto the trigger appendage. The components differ slightly on the various prior art mechanisms, relative to the independent manufacturer's own design. However, the functionality of the three components are similar on most the prior art mechanisms.

The hold-open feature is manually activated by first opening the door to a desired position, thus extending the piston rod of the fixated door closer system from within the piston body. A counter-force is then normally created as a result of the system's biasing operators. The checking mechanism is axially mounted onto the rod through the aperture configuration, first by moving the mechanism to a desired position on the extended rod. Releasing the door, the biasing operators act to return the rod towards the normally retracted position within the body. The biasing force causes the mechanism to lever at the trigger appendage, once the body contacts the mechanism upon the trigger point.

The biasing force is redirected at the fixated joint which causes the checking mechanism to torsionally pivot on the center axis of the aperture configuration, and pivot on the axis of the piston rod. Thus, the mechanism pivotally engages onto the rod surface, urged upon the metallic edges of the opposing loci comprising the opposing friction points. The energy is substantially equalized and distributed to the points which interact and deliver the friction within the axial plane of the mechanism. The direct frictional pressure created by the points is applied onto the curved and non-curved surfaces of the piston rod, whereby the mechanism frictionally checks the device. More biasing force controlled by the device results in more torsional pressure causing the friction onto the surfaces of the rod. Sectionally dividing the mechanism through the common axis of symmetry and connecting the opposing points within the axial plane, connected to the trigger point, a simple angle is illustrated. Therefore, the reader can better understand the principles of pressure distribution, and the distance from the trigger point to the opposing loci comprising the opposing friction points.

Component a) the aperture configuration is not a primary embodiment of this divisional invention. However, full disclosure can be learned within the parent application.

Component b) the trigger appendage acts as a lever to leverage the mechanism for pivotal engagement upon the device. The trigger appendage transposes the biasing forces controlled by the device into the direct frictional pressure upon the rod. The trigger appendage provides a trigger point for abutment onto the piston body. The trigger point varies upon the surface of the trigger appendage. The trigger point is defined upon a trigger plane. The trigger plane generally projects from the origin axis for the fixated joint, projected to the trigger point abutting the body of the device. Because the surface of the trigger appendage is substantially flat and also projects from the origin axis, the trigger plane therefore remains fixated as the trigger point varies upon the surface of the trigger appendage. Thus, in prior art the trigger point is best defined upon a non-variable trigger plane. The flat surface of the trigger appendage offers no other adjustable features for the varying trigger point.

Prior art checking mechanism provide a substantially similar distance between the three functional points of leverage. Specifically, the distance from the trigger point to the fulcrum locus is not much greater than the distance between the opposing friction points within the loci. An average door closer system comprising a 1.25" (32 mm) piston body and 0.313" (8 mm) piston rod, comprises a 1.5-to-1 average leverage ratio for the mechanism. Again, unless the piston rod is modified, the distance between the two opposing points can not be modified. Resultantly, the sectional distance between the two opposing points may never become altered or decreased to partake in any possible leverage advantage for the trigger point.

It may seem obvious that to obtain an increase in leverage ratio, the length of the trigger appendage should therefore be increased. However, merely increasing the length of the fixated trigger appendage would require decreasing the fixated joint, because of the flattened nature comprising the trigger appendage. The flattened surface of the trigger appendage limits the trigger point to the non-variable trigger plane, and will not compensate for an increase in the surface area resulting from any lengthening of the trigger appendage. Lengthening the trigger appendage would also place more stress onto the joint, further weakening the mechanism which often does not comprise hardness or temper modification for the soft sheet steel gauge.

The trigger appendage must create a functional gap between the central structure and the piston body. The gap must prevent any simultaneous touching of the central structure against the body, which disrupts the direct frictional pressure created by the opposing points upon the rod. The flattened trigger appendage also offers less surface area to increase the functional gap. As the checking mechanism wears and fatigues, the trigger point changes and climbs the surface of the flattened trigger appendage. Due to the non-variable trigger plane, the functional gap is reduced at the same rate as the climbing trigger point. Thus, there is less surface for the trigger appendage to provide certain variable extension and adjustment for a wearing checking mechanism. The flattened trigger appendage also offers less universalness to adapt a single checking mechanism to various devices.

Component c) the fixated joint comprises an angular connection between the central structure and the trigger appendage. The joint angularly directs the biasing forces controlled by the door closer biasing operators, to the opposing points torquing within the axial plane which cause the direct frictional pressure. All prior art checking mechanisms disclosed demonstrate a fixated joint which is greater than 90 degrees at the origin for both components. Some modern checking mechanisms comprise angular fixated joints as great as 120 degrees at the origin. The angle at the origin is determined by projecting an axis (face axis) upon the face of the central structure, and projecting the other axis (origin axis) from the origin for the trigger appendage. The origin may be determined as the best angle created between both components.

Among other factors, the angle must limit the central structure from simultaneously touching against the piston body along with the trigger point. Any simultaneous touching of the central structure disrupts the torsional engagement between the opposing friction points urged upon the rod. Therefore, the degree of the angle for the fixated joint must contribute to the functional gap between the central structure and the piston body. Because the prior art mechanisms are primarily manufactured from common sheet steel which is relatively soft, the joint is therefore subject to fatiguing which reduces the functional gap. In order to provide a mechanism which does not slip, the joint should be both fixated and capable of withstanding sufficient pressure. U.S. Pat. No. 3,566,435 to Nakamura (1971) shows a perpendicular angular joint which is not fixated. Resultantly, this mechanism provides an intentional slipping feature as described within the contents of the patent.

Another known problem contributing to a substantial reduction in the functional gap is defined by the natural wearing of the metallic edges which comprise the opposing friction points. The wearing causes the points to flatten which may result in a loss of substantial direct frictional pressure. Thus, the pressure becomes distributed over the two flattened points instead of being forcefully urged, as upon sharper biting edges comprising the loci of a branch new checking mechanism. A decrease in the functional gap may also be caused by the lateral rotation of the mechanism as previously described. Conclusively, any substantial reduction in the functional gap may ultimately render the mechanism useless.

Consider the results of a pressure test conducted on a prior art checking mechanism manufactured from 12 gauge sheet steel, comprising a flattened central structure; a flattened trigger appendage comprising the trigger point upon a non-variable plane projecting from the origin axis; and an fixated joint of approximately 120 degrees. The specimen checking mechanism was mounted to check a modern door closer comprising a 1.25" diameter piston body, with a 0.3125" diameter piston rod. With only the pressure created by the door closer biasing means, after pivotal engagement the average measurable functional gap between the central structure to end cap of the piston body was approximately 0.068". At 50 lbs. of direct pressure placed upon the end of the door closer rod, the fixated joint began fatiguing and widened, and the functional gap was reduced to 0.035". At 115 lbs. of direct pressure, the fixated joint had sufficiently fatigued to reduce the functional gap to 0.000", causing the central structure to simultaneously contact the piston body along with the trigger point area.

The results of this test concluded that an increase in the pivotal engagement substantially eliminated the functional gap between the central structure and the end cap, thus canceling the trigger mechanism and causing the checking mechanism to completely fail. Thus, it seems obvious that prior art checking mechanisms would benefit by moving the central structure away from the piston body to increase the functional gap. This could be achieved by decreasing the fixated joint to less than 90 degrees at the origin, thus raising the trigger area upon the non-variable plane of the flattened surface comprising the trigger appendage. The foregoing would increase the described functional gap, and increase the life of the checking mechanism. Tempering, hardening, and further modifying the joint with crimping, could create a mechanism capable of withstanding a greater pressure.

SUMMARY OF THE INVENTION

By decreasing the fixated joint to comprise an angle which is substantially perpendicular or less, in combination with an improved trigger appendage design, a substantial increase in leverage is created. The superior trigger appendage would comprise a substantial and continual curvature surface, thus disposing a trigger point upon a variable trigger plane and projecting a disposable surface from the origin axis for the fixated joint. Resultantly, the leverage is increased; the functional gap is increased; the torsion created within the axial plane is increased; the direct frictional pressure is increased; and a superior, universal checking mechanism is created to extend the life of the complete door closer system.

This invention comprises an improved checking mechanism, utilized for frictionally checking a reciprocative device including door closer systems. The objects and advantages of the invention include substantial improvements to the major components of the simple checking mechanism; b) the trigger appendage; and c) the fixated joint connecting component a* onto component b. (*detailed in parent application)

Superior component b) the trigger appendage provides a substantial increase in surface area, disposing a trigger point upon a substantial curvature surface. The superior trigger appendage comprises a substantially greater sectional distance between the trigger point and the fulcrum locus, than the sectional distance between the opposing points within the loci. An object of these inventions are to provide a substantial increase in torsion between the opposing friction points. Another object of these inventions are to provide a trigger point upon a variable trigger plane. Another object of these inventions are to create more surface area to comprise the trigger point. Another object of these inventions are to create more universalness for the mechanism to various door closer sizes and designs. Another object of these inventions are to increase the distance from the trigger point to the fulcrum locus. Another object of these inventions are to project the disposable surface from the origin axis for the fixated joint. Another object of these inventions are to project the disposable surface to dissect the origin axis. Another object of these inventions are to provide an adjustment means for the trigger point upon the variable trigger plane. Another object of these inventions are to accommodate for worn or wearing opposing friction points. Another object of these inventions are to compensate for an increase in pivotal engagement. Another object of these inventions are to assist in maintaining a vertical posture for the central structure. Another object of these inventions are to assist in strengthening the fixated joint, by possibly directing the biasing force towards the joint. Another object of these inventions are to increase leverage for the trigger point. Another object of these inventions are to increase the functional gap and decrease the motion of the pivotal engagement for the mechanism.

The inventive mechanism may incorporate a second trigger plate appendage. An object of this invention is to change the direction of the friction pressure torsionally applied onto the surfaces of the rod, thus creating a reversible mechanism. Another object of this invention is to accommodate the various reciprocating operative devices.

The trigger point may be comprised upon different modified trigger appendage surface designs including a substantial arching, ovoid, or convex design, an installed pad, cap, or clip, and an adjustable screw. An object of this invention is to provide the means for further extending and varying the trigger point away from the lower-fulcrum locus. Another object of this invention is to provide a trigger point area upon a substantial curvature surface. Another object of this invention is to accommodate for worn or wearing friction pressure points. Another object of this invention is to maintain a substantial vertical posture for the central structure.

Superior component c) the fixated joint, has been changed to comprise an angle at the origin which is substantially 90 degrees or less. An object of this invention is to accommodate a superior trigger appendage design comprising a substantial curvature surface disposing a trigger point upon a variable trigger plane projecting from the origin axis. Another object of this invention is to possibly project said curvature surface above the origin axis. Another object of this invention is to provide a stronger checking mechanism that can withstand greater direct frictional pressure. Another object of this invention is to create more universalness for the checking mechanism concept, adapting the new trigger appendage design to other prior art checking mechanism concepts. Another object of this invention is to compensate for an increase in pivotal engagement due to certain checking mechanism fatigue. Another object of this invention is to eliminate slippage due to simultaneous central structure contact upon the piston body, by decreasing the pivotal engagement and increasing the functional gap.

Furthermore, material comprising the joint may be tempered, hardened, and crimped. An object of this invention is to provide superior durability for the mechanism, and more particularly, to substantially eliminate any flexation of the fixated joint.

These and further objects of the invention will be apparent from the following description of the preferred embodiments thereof.

BRIEF DESCRIPTION OF THE DRAWINGS

FIG. 7 is a reference list.

DETAILED DESCRIPTION OF THE PREFERRED EMBODIMENTS

Figure 1:
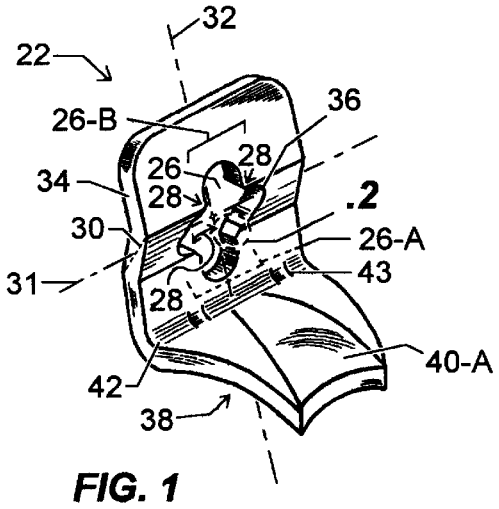
FIG. 1 is a prospective view of a superior checking mechanism or which illustrates an aperture configuration designed with notches and shown with modified opposing friction points including a point encircled for enlargement, and also showing a trigger appendage comprising a substantial curvature surface consisting of an ovoid, or convex design.
Figure 2:
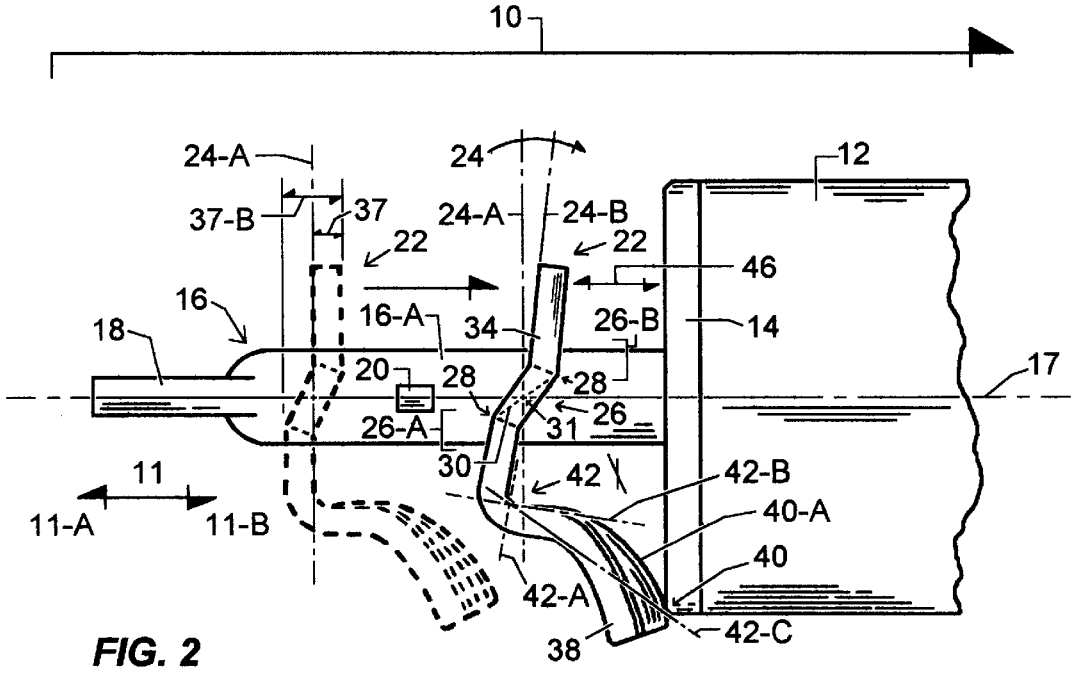
FIG. 2 is a side view of a reciprocative device comprising a door closer system, illustrating the superior checking mechanism of FIG. 1, foremost shown checking the extended piston rod. The mechanism is also shown superimposed in an idle position on the rod.

FIG. 1 and FIG. 2 are taught conceptually together wherein the checking mechanism 22 is stamp manufactured from a predetermined sheet metal gauge 37, although the mechanism 22 could be made from synthetic material with separately inserted metallic loci 26-A and 26-B. The mechanism 22 comprises a aperture configuration 26 bounded within a central structure 34 forming a fulcrum locus 26-A opposing a counter locus 26-B, composed upon a common axis of symmetry 32. The central structure 34 is attached to the trigger appendage 38 by the fixated joint 42.

FIG. 2 illustrates the superior checking mechanism 22 shown in FIG. 1, mounted upon the reciprocative device 10. The mechanism is mounted on the rod 16 axially 17, by means of the center aperture 26 bound within the central structure 34. The superimposed mechanism 22 is shown in an idle position 24-A, residing between the support hub 18 and the protruding lug 20. The biasing means 11 extends the rod 16 away from the body 12 with outward force 11-A. For engagement, the superimposed idle mechanism 22 is moved past the protruding lugs 20 on the extended rod 16, into the position of the foremost shown mechanism 22. Inward biasing force 11-B controlled by the device 10 returns the rod 16 towards the body 12. The functional gap 46 shows the distance between the mechanism 22 and the cap 14 of the body 12.

The trigger appendage 38 transposes the biasing forces 11 controlled by the device 10 into the direct frictional pressure 29 upon the rod 16. The trigger appendage 38 acts as a lever and causes the foremost mechanism 22 to pivotally engage 24 into a checking position 24-B. The trigger appendage 38 comprises a substantial curvature surface including a substantial arching, ovoid, or convex design 40-A. The trigger appendage 38 disposing the trigger point 40, contacts the body 12 and end cap 14. The trigger point 40 comprises the means to substantially vary upon the surface of the trigger appendage 38. The trigger point 40 is defined upon a trigger plane 42-C. The trigger plane 42-C generally projects from the origin axis 42-B for the fixated joint 42, and projected to the trigger point 42 abutting the body 12 of the device 10. As the trigger point 40 varies upon the surface of the trigger appendage 38, the trigger plane 42-C also varies. Thus, the trigger point 40 is defined upon a superior variable trigger plane 42-C.

Because of the physics of the substantial curvature surface, more surface area becomes available to accommodate the trigger point 40. The increase in surface area substantially increases the functional gap 46. Thus, the mechanism 22 maintains a better vertical posture, and the pivotal engagement 24 is reduced. The mechanism 22 becomes more universal and adjustable for various types of devices 10, including various diameters of piston bodies 12, end caps 14, and rods 16. The curvature surface can also compensate for fatiguing of the fixated joint 42 and wearing of the opposing friction points 28. It shall be stated that the inventive concept of the points 28 comprising direct frictional pressure 29 away from the common axis of symmetry 32, may be fully incorporated with out the need to utilize a curvature surface the trigger appendage 38. However, the nature of the curvature surface promotes adjustability for the mechanism 22.

The fixated joint 42 redirects the biasing means 11 which causes the mechanism 22 to pivot on the center axis 31 of the aperture configuration 26, and the axis 17 of rod 16. The preferred fixated joint 42 between the central structure 34 and the trigger appendage 38 comprises an angle of 90 degrees or less at the origin. The narrowness of the joint 42 creates a stronger checking mechanism 22 which substantially eliminates flexation at the joint 42, by possibly directing pressure towards the joint 42. The joint 42 also accommodates the trigger appendage 38 comprising the substantial arching, ovoid, or convex design 40-A. The joint 42 may comprise a strengthening means 43 such as tempering, hardening, and crimping.

Figure 3:
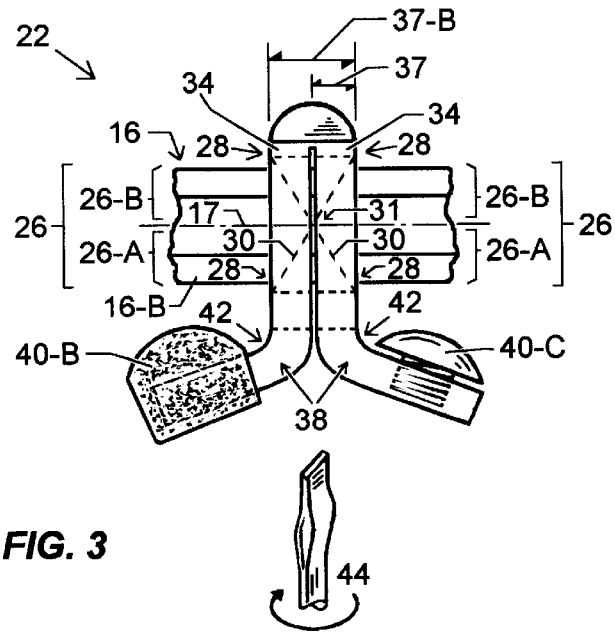
FIG. 3 is a side view of a conceptual mechanism comprising a central structure upon two separate bodies, also showing two trigger appendages with various trigger point options, and shown upon a partial piston rod comprising non-curved surfaces. A method for adjusting the mechanism is also illustrated.
Figure 4:
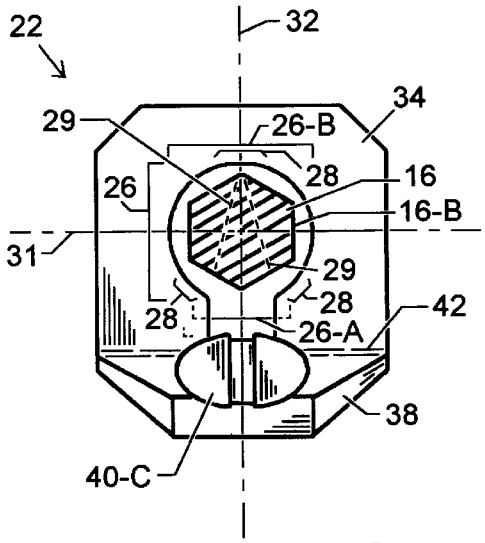
FIG. 4 is a front view of the mechanism shown in FIG. 3 which illustrates the aperture configuration comprising a minimum of three opposing frictional points, showing the trigger point upon an adjustable screw, and illustrated upon a sectional view of the piston rod comprising non-curved surfaces.

FIG. 3 and FIG. 4 show a conceptual mechanism 22 comprising plural central structures 34 and trigger appendages 38. Among other issues, this conception is useful to provide adjustment for worn friction pressure points 28, and to accommodate for variously sized and types of reciprocative devices 10 including varied piston rod 16 and piston bodies 12. The aperture shows the three friction pressure points positioning at least one point 28 on the fulcrum locus 26-A and two points 28 at the counter locus 26-B. Note that the direct frictional pressure 29 is not linearly aligned upon the common axis of symmetry 32. The loci 26-A and 26-B comprise substantially larger points 28. Plural central structures 34, separate yet attached to each other, may provide variable opposing points 28 for the loci 26-A and 26-B within the axial plane 30. Adjustment is made perhaps with the blade of a screwdriver, by slightly prying or separating 44 the two central structures 34. Other methods of separating the loci 26-A and 26-B to comprise variability within the axial plane 30 may be utilized without departing from the invention disclosed therein.

Reversibility of the mechanism 22 may result from plural trigger appendages 38, as both the outward force 11-A and inward force 11-B may be checked. The trigger appendages 38 demonstrate a trigger point 40 both upon an adjustable screw 40-B, and a pad or clip 40-C. The mechanism 22 is conceptually illustrated upon piston rod 16 comprising non-curved surfaces 16-B. The mechanism 22 may be rotated about the rod 16 so that the points 28 coincide with the edges of the non-curved surfaces 16-B. Furthermore, the mechanism 22 can be made from an organic or synthetic material with the points 28 separately inserted. Insertion of the points 28 may require that the central structure 34 be composed of two mating parts held together with a fastening means. It shall be stated that the preferred offsetting planes 37-B are created within the plural and thicker central structures 34.

Figure 5:
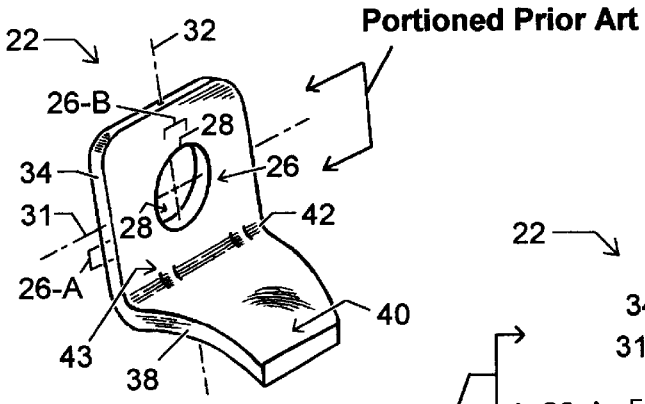
FIG. 5 is a prospective view of a checking mechanism comprising a prior art central structure fixated to a superior convexity design trigger plate appendage which comprises a substantial curvature surface disposing a variable trigger area upon a variable plane.
Figure 6:
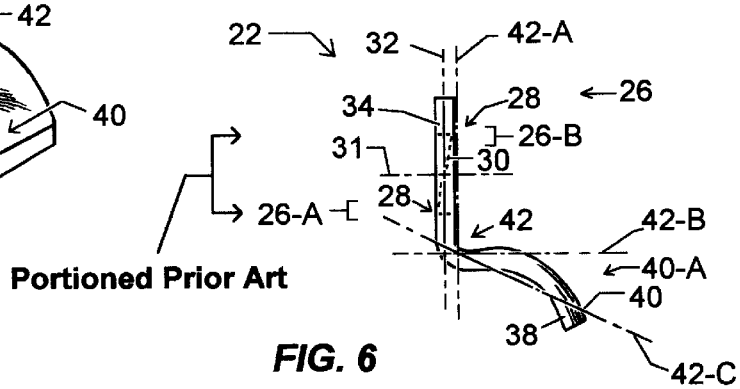
FIG. 6 is a side view of the checking mechanism shown in FIG. 6 divided upon the common axis of symmetry, illustrating the fixated joint which is substantially 90 degrees or less, illustrating the trigger appendage comprising the simple arching design.

FIG. 5 and FIG. 6 are taught conceptually together wherein FIG. 5 illustrates the inventive concept in combination upon a hold-open bracket 22 comprising a prior art circular aperture configuration 26 with two friction pressure points 28 comprising the opposing torsional pressure 29 (not shown) within the axial plane 30. The central structure 34 is fixated to the superior trigger plate appendage 38 by the fixated angular joint 42 of approximately 90 degrees or less at the origin. The fixated angular joint 42 comprises a strengthening means 43 such as tempering, hardening, and crimping. The trigger plate appendage 38 comprises the point 40 upon a substantial curvature surface, consisting of a more simplified arching design for transposing a torsional pressure 29 between the opposing points 28 within the axial plane 30.

If the reader chooses to argue that certain prior art disclosed herein may possibly comprise a variable trigger area 40 disposed upon a variable plane 42-C, due to any secondary angle comprising the angular fixated joint 42, such a disposable surface would certainly not comprise a substantially curvature surface, nor comprise a variable trigger point 40 disposed upon a substantially variable trigger plane 42-C, due to the substantially flattened nature of all the prior art trigger appendages 38 disclosed herein.

For example, U.S. Pat. No. 2,920,338 to Falk (1960) shows a trigger appendage (61) which appears to comprises a gradual radius, fixated angularly to the central structure at a substantial 90 degree angle. However, as described in the patent the trigger appendage (61) is "bent downwardly" from the 90 degree fixated angle, as the word "bent" is best defined as "being changed out of a straight or even condition such as with twigs". The patent does not demonstrate nor define the trigger appendage (61) as comprising a variable trigger area upon a substantially variable plane, nor as comprising a substantially curvature surface projecting from the origin axis.

The particular embodiments of the present invention which have been illustrated and discussed herein are for illustrative purposes only and are not considered as a limitation upon the scope of the appended claims. In these claims set forth, it is my intent to claim the entire invention disclosed herein, except as I am limited by the prior art.

Accordingly, the scope of the invention should not be determined only by the embodiments illustrated, but also by the appended claims and their legal equivalents. From the above description of the invention submitted, various changes and modifications and improvement may occur to the apparatus. All such claims are intended to be included therein.

I claim:

1. A method for checking reciprocative devices (10) including door closer systems (10) comprising a rod (16) that functions reciprocatively from within a body (12) having a biasing means (11), that, upon extension of said rod (16) from within said body (12), said device (10) normally acting to control the reciprocation of said rod (16); said checking is performed frictionally by means of a checking mechanism (22) composed of a predetermined, hardened and tempered sheet metal gauge (37) for mounting axially (17) onto said rod (16), comprising an aperture configuration (26) bounded within a central structure (34) disposing a fulcrum locus (26-A) opposing a counter locus (26-B), both diametrically composed upon a common axis of symmetry (32) and each providing at least one substantial opposing friction point (28) for urging upon the surfaces (16-A) (16-B) of said rod (16) a substantial direct frictional pressure (29) created within an axial plane (30); said mechanism (22) further including at least one trigger appendage (38) angularly attached to said central structure (34) to form a fixated joint (42) projectable by projecting one axis (42-A) upon the face of said central structure (34), and projecting the other axis (42-B) from the origin of said fixated joint (42); said trigger appendage (38) disposing a trigger point (40) to abut against said body (12) upon a trigger plane (42-C) projected from the origin axis (42-B) and projected to the abutting trigger point (40); wherein said common axis of symmetry (32) coincides upon a diametric cross-section of said rod (16) engaged thereto, comprising the steps of applying a force (11-A) to cause the rod (16) to be at least partially extended from within said body (12), thereby creating a reciprocative counter-force (11-B);

leveraging said mechanism (22) to pivotally engage (24) said rod (16) responsive to said trigger point (40) abutting said body (12), wherein said trigger plane (42-C) comprises the means to substantially vary as the abutting trigger point (40) also varies upon the surface of said trigger appendage (38), and wherein the distance from said trigger point (40) to a friction point (28) upon said fulcrum locus (26-A) comprises a substantially greater distance than the distance between the opposing friction points (28) within the loci (26-A) and (26-B);

torquing said surfaces (16-A) (16-B) of said rod (16) between said opposing friction points (28) within the loci (26-A) and (26-B), to comprise a cross-sectional distance created between the points (28) which is substantially less than the cross-sectional diameter of said rod (16) upon said common axis of symmetry (32);

urging said points (28) upon the rod surfaces (16-A) (16-B) wherein said direct frictional pressure (29) within said axial plane (30) is not in substantial linear alignment upon said common axis of symmetry (32);

resisting the movement of said biasing means (11) normally acting to control the reciprocation of said rod (16), responsive to said direct frictional pressure (29) urged between said opposing friction points (28).

2. The method for checking reciprocative devices (10) of claim 1, wherein said step of leveraging said mechanism (22) is performed by said trigger appendage (38) comprising a substantial curvature surface selected from the group consisting of an substantial arching, ovoid, and convex design (40-A), an installed pad or clip (40-B), and an adjustable screw means (40-C), whereby said curvature surface is also projected from said origin axis (42-B) and projected to the abutting trigger point (40).

3. The method for checking reciprocative devices (10) of claim 1, wherein said fixated joint (42) angularly attaching said trigger appendage (38) onto said central structure (34) comprising an angle at substantially 90 degrees or less.

4. The method for checking reciprocative devices (10) of claim 3, wherein said fixated joint (42) further comprising a strengthening means (43) selected from the group consisting of tempering, hardening, and crimping.

5. The method for checking reciprocative devices (10) of claim 1 wherein said loci (26-A) and (26-B) are composed upon separate and variable bodies comprising said central structure (34), whereby varying the distance between said opposing points (28) within said axial plane (30).

6. A checking mechanism (22) composed of a predetermined, tempered and hardened metal gauge (37) for frictionally checking reciprocative devices (10) including door closer systems (10) comprising a rod (16) that functions reciprocatively from within a body (12) having a biasing means (11), that, upon displacement of said rod (16) from within said body (12), said device (10) normally acting to control the reciprocating of said rod (16); said checking mechanism (22) axially (17) mountable onto said rod (16) wherein a common axis of symmetry (32) coincides upon a diametric cross-section of said rod (16) engaged thereto, comprising an aperture configuration (26) bounded within a central structure (34) disposing a fulcrum locus (26-A) opposing a counter locus (26-B), both diametrically composed upon said common axis of symmetry (32) and each providing at least one substantial opposing friction point (28) for urging upon the surfaces (16-A) (16-B) of the rod (16) a substantial direct frictional pressure (29) created within an axial plane (30);

a trigger appendage (38) for abutting against said body (12) disposing a trigger point (40) upon a variable trigger plane (42-C) projecting from an axis (42-B) originating an angular fixation of said trigger appendage (38) onto said central structure (34), and projected to the abutting trigger point (40), wherein said trigger plane (42-C) comprising the means to vary substantially as said abutting trigger point (40) also varies upon the surface of said trigger appendage (38);

said angular fixation comprising a fixated joint (42) to form an angle of substantially 90 degrees or less comprising an axis (42-A) projected upon the face of said central structure (34), and comprises the other axis (42-B) projected from the origin said fixated joint (42).

7. The checking mechanism (22) for frictionally checking reciprocative devices (10) of claim 6 wherein said fixated joint (42) further comprising a strengthening means (43) selected from the group of tempering, hardening, and crimping.

8. The checking mechanism (22) for frictionally checking reciprocative devices (10) of claim 6 wherein the distance between the opposing points (28) within the opposing loci (26-A) and (26-B) comprises a substantially lesser distance than the distance between the trigger point (40) to the fulcrum locus (26-A).

9. The checking mechanism (22) for frictionally checking reciprocative devices (10) of claim 6 wherein said trigger appendage (38) comprises a substantial curvature surface disposing said trigger point (40) thereupon, selected from the group consisting of a substantial arching, ovoid, and convex design (40-A), an installed pad and clip (40-B), and an adjustable screw means (40-C), whereby said curvature surface is also projected from said origin axis (42-B) and projected to the abutting trigger point (40).

10. The checking mechanism (22) for frictionally checking reciprocative devices (10) of claim 6 wherein said opposing friction points (28) comprising a modification selected from the group of tempering, hardening, plating, coating, tipping, and separately inserting said points (28) into said central structure (34).

11. The checking mechanism (22) for frictionally checking reciprocative devices (10) of claim 6 wherein said central structure (34) forming said aperture (26) so shaped to comprise that certain areas which do not define said opposing friction points (28) dispose notches (36) to expand said aperture (26), wherein said mechanism (22) may mount upon a rod (16) comprising diametrically widened supporting hub (18) or protruding lugs (20) greater than the diameter of said rod (16).

12. The checking mechanism (22) for frictionally checking reciprocative devices (10) of claim 6 further comprising said central structure (34) separated upon different bodies, wherein the distance between said opposing points (28) within said loci (26-A) and (26-B) comprise variability within said axial plane (30).

13. An improved checking mechanism (22) for checking reciprocative devices (10) including door closer systems (10) comprising a rod (16) that functions reciprocatively from within a body (12) having a biasing means (11), that, upon extension of said rod (16) from within said body (12), said device (10) normally acting to control the reciprocation of said rod (16); said checking is performed frictionally by means of a checking mechanism (22) for mounting axially (17) onto said rod (16), comprising an aperture configuration (26) bounded within a central structure (34) disposing a fulcrum locus (26-A) opposing a counter locus (26-B), both diametrically composed upon a common axis of symmetry (32) and each providing at least one substantial opposing friction point (28) for urging upon the surfaces (16-A) (16-B) of said rod (16) a substantial direct frictional pressure (29) created within as axial plane (30); said mechanism (22) further including at least one trigger appendage (38) angularly attached to said centrol structure (34) to form a fixated joint (42) projectable by projecting an axis (42-A) upon the face of said central structure (34), and projecting the other axis (42-B) from the origin of the fixated joint (42); said trigger appendage (38) disposing a trigger point (40) to abut against said body (12) upon a trigger plane (42-C) projected from the origin axis (42-B) and projected to the abutting trigger point (40); wherein said common axis of symmetry (32) coincides upon a diametric cross-section of said rod (16) engaged thereto, in combination the improvements comprising the opposing friction points (28) comprise a modification means selected from the group of tempering, hardening, plating, coating, tipping, and a separate insertion into said central structure (34);

the surface of said trigger appendage (38) disposing said trigger point (40) upon said trigger plane (42-C) variably, wherein said trigger plane (42-C) comprising the means to substantially vary as said abutting trigger point (40) varies upon the surface of said trigger appendage (38);

said fixated joint (42) composed to form an angle of substantially 90 degrees or smaller, and said fixated joint (42) further comprising a strengthening means (43) selected from the group of tempering, hardening, and crimping;

whereby said improvements comprise a superior checking mechanism (22) for frictionally checking said device (10), by providing the maximum direct frictional pressure (29) created between said opposing points (28) within said axial plane (30).

14. The improved checking mechanism (22) of claim 13 wherein said surface of said trigger appendage (38) disposing said trigger point (40) comprises a substantial curvature surface selected from the group consisting of a substantial arching, ovoid, and convex design (40-A), an installed pad and clip (40-B), and an adjustable screw means (40-C) whereby said curvature surface is also projected from said origin axis (42-B) and projected to the abutting trigger point (40).

15. The improved checking mechanism (22) of claim 14 wherein the distance between said trigger point (40) to the fulcrum locus (26-A) comprise a substantially greater distance than the distance between the opposing points (28) within the opposing loci (26-A) and (26-B).

16. The improved checking mechanism (22) of claim 13 wherein said central structure (34) forming said aperture (26) so shaped to comprise that certain areas which do not define said opposing friction points (28) dispose notches (36) to expand said aperture (26), wherein said mechanism (22) may mount upon a rod (16) comprising diametrically widened supporting hub (18) or protruding lugs (20) greater than the sectional diameter of said rod (16).

17. The improved checking mechanism (22) of claim 13 wherein said central structure (34) separated upon different bodies, wherein the distance between said opposing points (28) within said loci (26-A) and (26-B) comprises the means for variability within said axial plane (30).

18. The improved checking mechanism (22) of claim 13 wherein composition for said mechanism (22) selected from the group of natural and synthetic metals, fibers, ceramics, and plastics.

* * * * *